US005228322A

United States Patent [19]

Del Fabro et al.

[11] Patent Number: 5,228,322

[45] Date of Patent: Jul. 20, 1993

[54] PLANT TO SELECT AND BEND BARS FOR BUILDING WORK

[75] Inventors: Giorgio Del Fabro, Cassacco-Fraz.; Marcello Del Fabro, Udine, both of Italy

[73] Assignee: M.E.P. Macchine Elettroniche Piegatrici SpA, Reana Del Rojale, Italy

[21] Appl. No.: 835,499

[22] Filed: Feb. 14, 1992

[30] Foreign Application Priority Data

Feb. 28, 1991 [IT] Italy ..... 000028 A/91
Dec. 20, 1991 [IT] Italy ..... 000214 A/91

[51] Int. Cl.[5] ..... B21D 43/20; B21D 43/26; B21D 7/16

[52] U.S. Cl. ..... 72/294; 72/217; 72/307; 72/424; 72/422

[58] Field of Search ..... 72/307, 294, 217, 424, 72/422, 149

[56] References Cited

U.S. PATENT DOCUMENTS

| | | | |
|---|---|---|---|
| 610,749 | 9/1898 | Treat | 72/424 |
| 3,871,288 | 3/1975 | White | 100/2 |
| 4,681,210 | 7/1987 | Miki et al. | 198/468.2 |
| 4,766,754 | 8/1988 | Shiue | 72/294 |

FOREIGN PATENT DOCUMENTS

| | | | |
|---|---|---|---|
| 0092462 | 10/1983 | European Pat. Off. . | |
| 188850 | 7/1986 | European Pat. Off. . | |
| 379030 | 7/1990 | European Pat. Off. . | |
| 379043 | 7/1990 | European Pat. Off. . | |
| 1502837 | 8/1970 | Fed. Rep. of Germany . | |
| 235469 | 11/1972 | Fed. Rep. of Germany . | |
| 2456086 | 6/1976 | Fed. Rep. of Germany . | |
| 2718744 | 11/1979 | Fed. Rep. of Germany . | |
| 3010923 | 10/1980 | Fed. Rep. of Germany | 72/307 |
| 3644482 | 7/1988 | Fed. Rep. of Germany | 72/307 |
| 7703672 | 9/1977 | France . | |
| 8006327 | 10/1980 | France . | |
| 2533477 | 3/1984 | France . | |
| 26616 | 3/1981 | Japan | 72/422 |
| 3830 | 1/1987 | Japan | 72/307 |
| 7204195 | 10/1973 | Netherlands . | |
| 424639 | 4/1974 | U.S.S.R. | 72/424 |
| 431933 | 6/1974 | U.S.S.R. | 72/424 |
| 794648 | 5/1958 | United Kingdom | 72/424 |
| 2026361 | 2/1980 | United Kingdom . | |

*Primary Examiner*—Daniel C. Crane
*Attorney, Agent, or Firm*—Antonelli, Terry, Stout & Kraus

[57] ABSTRACT

Plant and method to select and bend bars for building work, which is suitable to select and bend simultaneously in a substantially identical manner a plurality of bars, starting with substantially identical bars, the plant comprising at least one store, a first traversing roller conveyor, a shears for shearing to size, at least one movable arm to engage and position bars lengthwise and a supporting bench:

the first traversing roller conveyor (17) comprising means to butt a bundle of bars (14) by means of an abutment face (18), fork means (20) for the positioning and vertical alignment of the bundle of bars (14) being included between the first traversing roller conveyor (17) and the shears (39), the movable engagement and positioning arm (31) including in its lower portion a movable engagement gripper (34) and cooperating with the abutment face (18), a relative vertical movement taking place between the movable engagement arm (31) and the shears (39) during the transient time of the arm (31) passing the shears (39).

16 Claims, 8 Drawing Sheets

PLANT TO SELECT AND BEND BARS FOR BUILDING WORK

BACKGROUND OF THE INVENTION

This invention concerns a plant to select and bend bars for building work.

The plant according to the invention is correctly used in the field of processing reinforcement bars for building work, whether the bars are supplied in straight lengths or in rolls.

In particular, the plant to select and bend bars for building work makes possible the storage and prior sorting of the bars to be bent and their automatic feed towards a shearing and bending platform on which the bundles of bars are sheared and bent as required.

Nowadays the selecting, shearing and bending operations are carried out in at least two separate and distinct plants, of which one plant performs the selecting and shearing, whereas the other plant is located elsewhere and carries out the bending and shaping.

Documents FR-2.533.477, DE-2.718.744 and U.S. Pat. No. 3,871,288 disclose a plant to shear to size bars fed from a store.

Documents DE-2.352.469 and DE-2.456.086 disclose a movable carriage device to take bars from a bundle and to convey them beyond a shears that shears to size. The bars, when sheared to size, are conveyed to a bending-shaping plant by a suitable conveyor means such as a bridge crane, roller conveyor or tipper trucks or are deposited in suitable stores.

It is obvious that a great deal of time is wasted in the handling operations and that considerable space and long cycle times are required, and therefore the systems of the state of the art are hardly economical.

Moreover, the plants of the state of the art require many intermediate operations and are a source of accidents and danger for the machine operators.

As against this, the present production requirements favour as little used space as possible, limited cycle times, automation of the cycle, reduction of the labour force, less consumption of materials, less requirements of maintenance, greater safety for the employees, etc.

SUMMARY OF THE INVENTION

The present applicant has designed, tested and embodied this invention to avoid the shortcomings of the state of the art and to achieve further advantages.

The purpose of this invention is to provide a plant suitable to carry out with a continuous, automatic cycle the selection, shearing, bending and shaping of bars for building work and to reduce the space taken up to that substantially needed for one single plant.

Moreover, the invention makes possible lower consumption of materials, less random maintenance operations, greater safety for the machine operators, a smaller labour force, etc.

Contrary to the existing bending, shaping plants, the invention enables the bars to be prepared while the other operations are in progress, thus achieving a great increase in output.

Furthermore, the plant according to the invention obviates the use of means such as bridge cranes and tipper trucks to convey the bars from their storage and selection assemblies to the shearing and bending assembly, thus ensuring greater safety for the machine operators.

The plant enables the cycle times to be reduced and only one machine operator to be required since the various operations are, in fact, all automated.

The plant to select and bend the bars for building work comprises an assembly to store and select bars which includes a compartmented store in which the bars are positioned according to their cross section and their type of material, suitable feeder means, a roller conveyor to traverse and butt the bundle of selected bars and a bar positioner assembly to position the selected and butted bundle of bars.

A variant provides for the bars to be fed directly from rolls of bars in cooperation with, or in replacement of, the compartmented store. In this case the feed system consists of a bench for the rolls of material, a straightening machine, a shears and a roller conveyor cooperating either directly with the traversing roller conveyor or preferably with a second independent roller conveyor connected by suitable means to the bar positioner assembly.

Suitable independent feeder means are comprised between the traversing roller conveyor feeding the bundle of selected bars and the bar positioner assembly.

According to a variant the bar positioner assembly is capable of an auxiliary movement which enables that assembly to carry out also the functions of a transfer means.

A suitable movable arm is included in cooperation with the frontal portion of the bar positioner assembly and can slide along a runway positioned lengthwise along the shearing and bending platform and axially to the bundle of positioned bars; this movable arm is equipped with suitable engagement grippers to engage the bundle of positioned bars and has the task of displacing the bundle of bars axially and positioning it either in relation to the successive shearing assembly or in relation to the bending unit located on the shearing and bending platform.

The movable arm, when it passes in cooperation with the shears, is raised along the distance necessary for such passing and then is lowered to continue its path.

According to a variant the shears is lowered below the level of the shearing and bending platform for the time necessary for the movable arm to pass by.

Retaining means to clamp the bundle of bars in position during the bending step are included together with the bending unit on the same axis as the bars and upstream and downstream of the bending unit itself.

This bending unit enables bends to be accomplished in four directions depending on the initial positions taken up by the abutment roll and bending pin respectively of the bending unit in relation to the bundle of bars.

To be more exact, when the retaining means upstream of the bending unit clamp the bundle of bars, clockwise or anticlockwise bends can be made on the leading end of the bars, depending on whether the bending disk of the bending unit rotates clockwise or anticlockwise.

Instead, when the retaining means downstream of the bending unit clamp the bundle of bars, clockwise or anticlockwise bends can be made on the trailing end of the bars, depending on whether the bending disk of the bending unit rotates clockwise or anticlockwise.

A second movable arm may be included which acts downstream of the bending unit so as to speed up the operations of positioning the bars.

The bending unit cooperates with a large supporting bench since the embodiment of the invention enables bends of very large types to be made without the use of machine operators, thus achieving greater safety for the latter.

The supporting bench comprises conveyor means with projections arranged in a lengthwise direction, these means making possible the work of removing the bundle of sheared or bent bars.

Suitable auxiliary arms are included in cooperation with the bending unit and enable the same to make bends which may even lead to the superimposing of segments of the same bundle of bars on top of each other. These auxiliary arms have the task of lifting suitably the segment already bent, which otherwise would prevent the formation of successive bends to be made.

According to a variant, when the first bend has been made, the bundle of bars is fed forwards by the whole required length and is then sheared; next, the other bends are made by withdrawing the bundle of bars upstream each time for each bend and making the required bend each time.

According to yet another variant, when a plurality of bends have been made, the number of which may vary according to the shape of the finished stirrup to be made, the bundle of bars is fed forwards by the whole required length and is then sheared; next, the other remaining bends are applied by withdrawing the bundle of bars upstream each time for each bend and making the required bend each time.

The cycles described in the last two variants enable the bending unit to make even bends which cause segments of the bars to be superimposed on each other without the use of any auxiliary arms since it is the movable arm itself which grips and raises the initial segment containing at least the first bend of the bundle of bent bars, thus enabling the last bend to be applied without the segments of the bar contacting each other.

BRIEF DESCRIPTION OF THE DRAWINGS

The attached figures, which are given as a non-restrictive example, show some preferred embodiments of the invention as follows.

DESCRIPTION OF THE PREFERRED EMBODIMENTS

Figure 1:
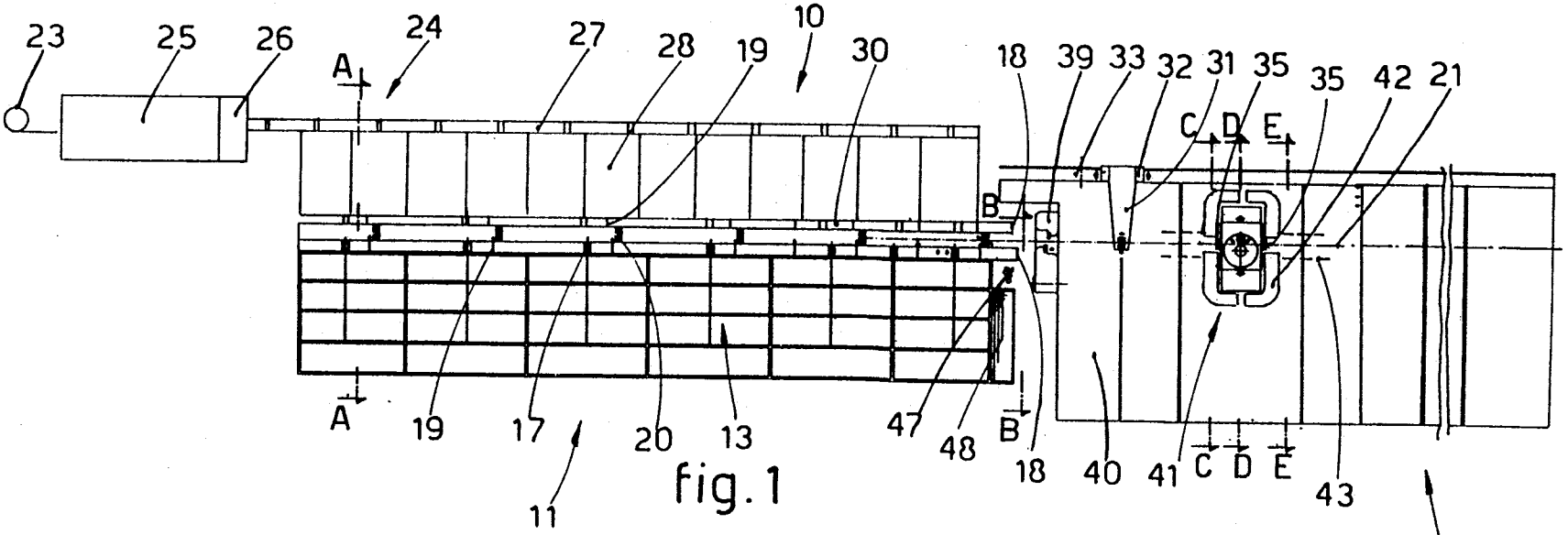
FIG. 1 is a plan view of a plant to select and bend reinforcement bars according to the invention.

In the figures the reference number 10 indicates generally a plant to select and bend reinforcement bars 14 according to the invention.

The plant 10 comprises a first storage and selection assembly 11 consisting in this case of a compartmented store 13 having a progressively decreasing height, within which are positioned bars 14 according to their cross section and the materials of which they are made.

Figure 2:
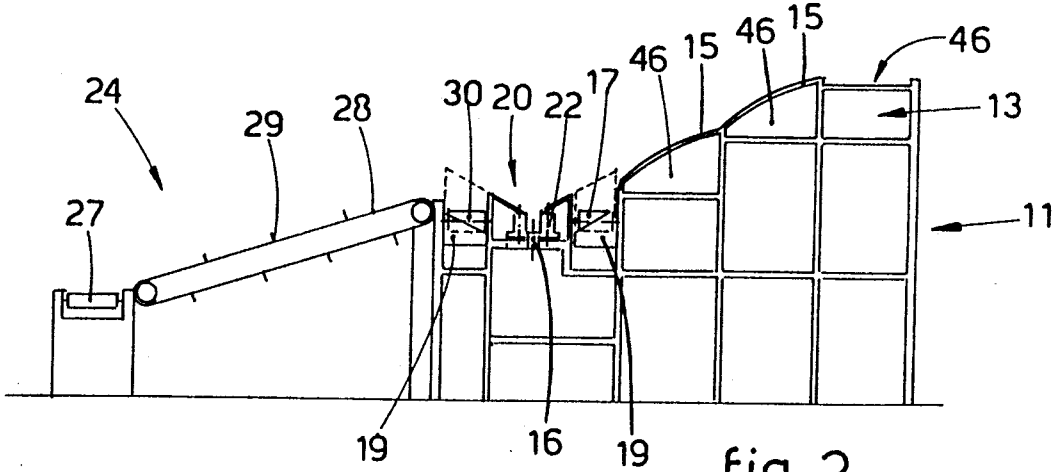
FIG. 2 shows a cross section of the storage, selection, butting and positioning assembly along the line A-A of FIG. 1.

Movable chutes 15 are comprised above the compartments and are kept lowered (as shown in FIG. 2) when bars 14 stored in an upstream compartment 46 have been selected, whereas the movable chute 15 is lifted to enable bars 14 to be withdrawn from the compartment 46 in which the bars 14 selected are stored.

A machine operator 47 is located at the downstream end of the compartmented store 13 and has raised steps 48 available to provide ready access to the compartment 46 in question.

The machine operator 47 selects the bars 14 required in the compartment 46 containing them and makes them slide on a first traversing roller conveyor 17 in the number required to form a bundle of selected bars 14 to be sheared and/or bent.

The first roller conveyor 17 has the task of butting the bundle of selected bars 14 against an abutment face 18 which acts as a butting means.

In the example shown the first traversing roller conveyor 17 cooperates with suitable transfer means 19 consisting of blades, which are lifted when required by the cycle so as to transfer the bundle of butted bars 14 into suitable positioner fork means 20.

In this example retractible stops 67 are included and free the passage from the first roller conveyor 17 to the positioner fork means 20.

Figures 12, 13:
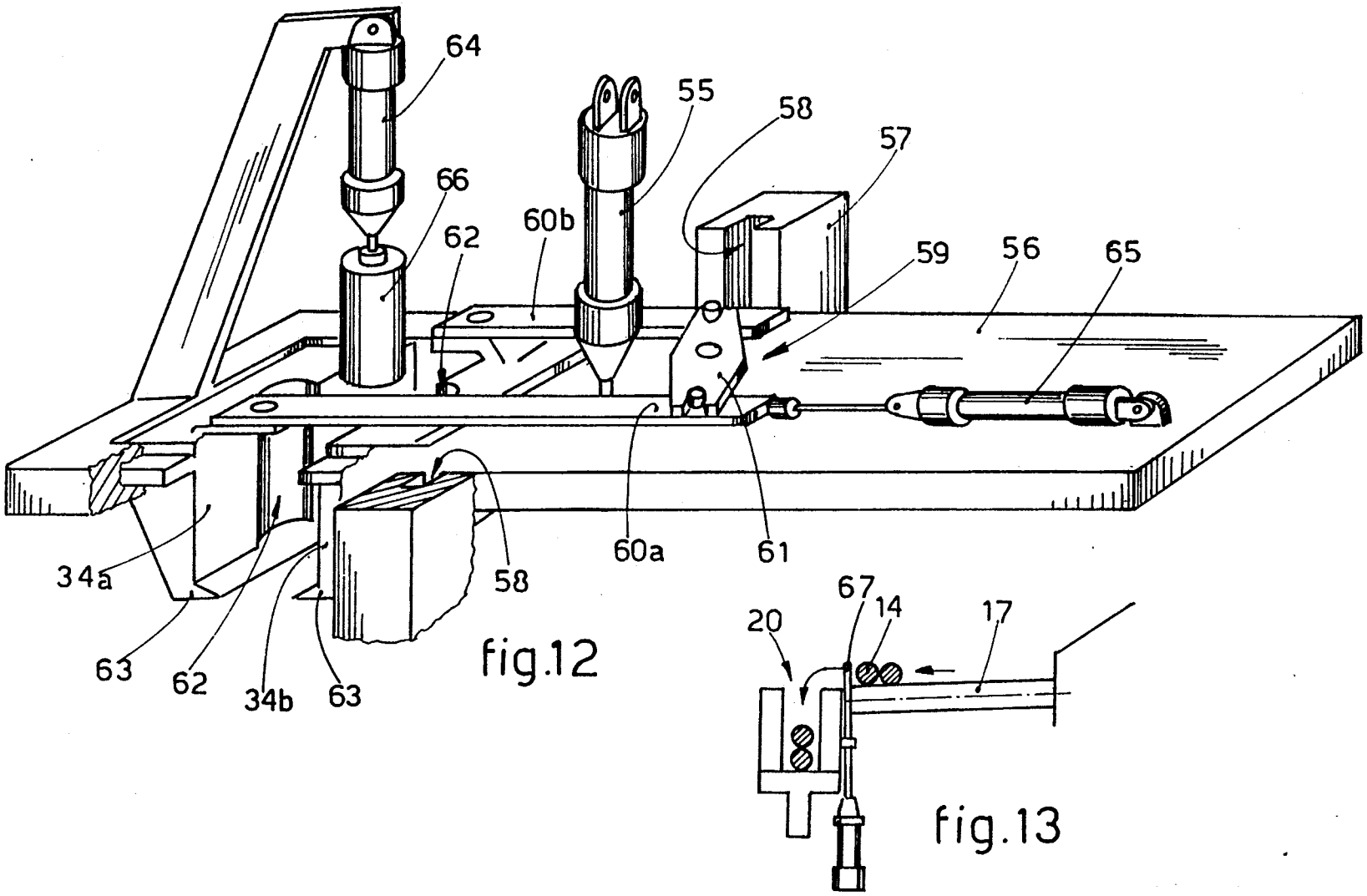
FIG. 12 is a partly cutaway three-dimensional view of the terminal portion of the movable arm.
FIG. 13 shows another method of transferring the bars from the first roller conveyor to the positioner forks.

According to the variant shown in FIG. 13, so as to obtain transfer of the bundle of bars 14 into the positioner fork means 20, the first roller conveyor 17 has its rollers sloped towards the fork means 20, so that the bars 14 are butted and then slide into the positioner fork means 20.

Figure 7A:
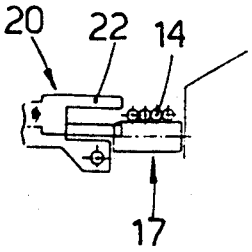
FIGS. 7*a*–7*c* show the bar positioner unit acting also as a transfer means.
Figure 7B:
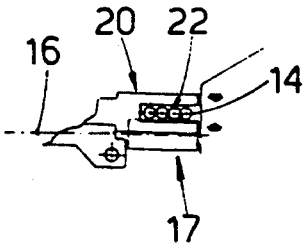

According to the variant shown in FIGS. 7 the transfer of a bundle of selected and butted bars 14 from the first roller conveyor 17, where the bundle is butted, to the positioner fork means 20 is achieved by rotating the positioner fork means 20 by about 90° (see FIG. 7*a*) and then displacing the fork means 20 towards the first roller conveyor 17 until all the bars 14 are contained between idler rollers 22 which compose the positioner fork means 20 (see FIG. 7*b*); the positioner fork means 20 containing the bundle of bars 14 are then either rotated about their central axis 16 so as to create a gripping effect or are brought towards each other so as to grip the bundle of bars 14 contained between them.

Figure 7C:
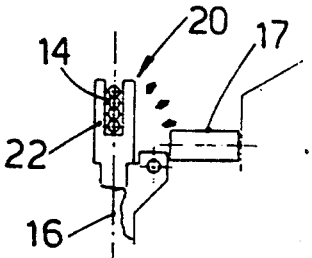

When the bundle of bars 14 has been gripped by the idler rollers 22 of the fork means 20, the fork means 20 are returned to their vertical position (see FIG. 7*c*).

In this example the fork means 20 comprise two idler rollers 22 having their axes substantially parallel and also parallel to the central axis 16 of the fork means 20.

In their normal position the idler rollers 22 have their axes positioned vertically.

The fork means 20, when in their vertical position again, rotate about their axis 16, so that one idler roller 22 presses on the righthand side and the other idler roller 22 on the lefthand side of the bundle of bars 14, thus ensuring that the bars 14, whatever their diameter, in the bundle are positioned, one above another, exactly on the central axis 16.

Figure 9A:
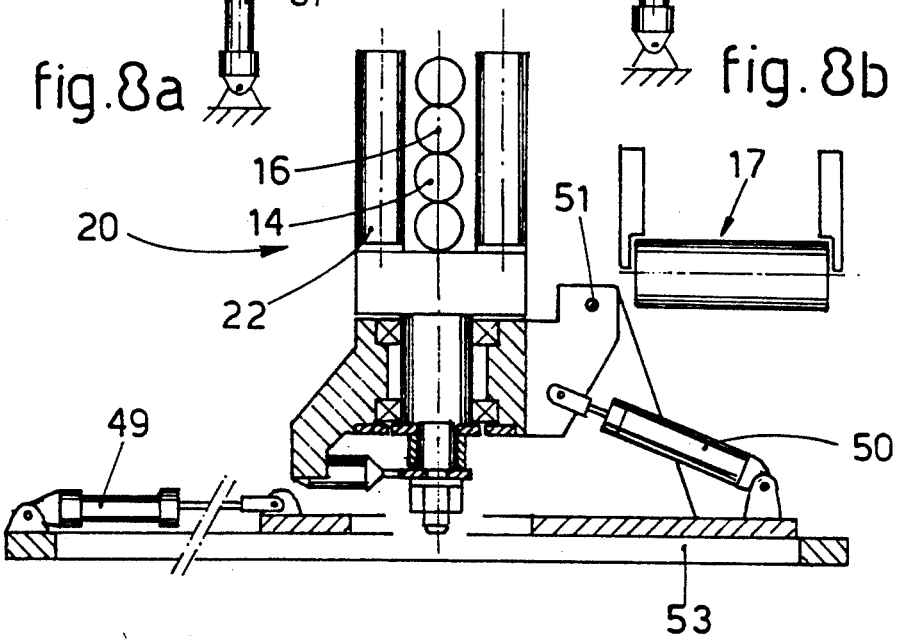
FIGS. 9*a* and 9*b* show the fork means that position the bars together with their actuation means.
Figure 9B:
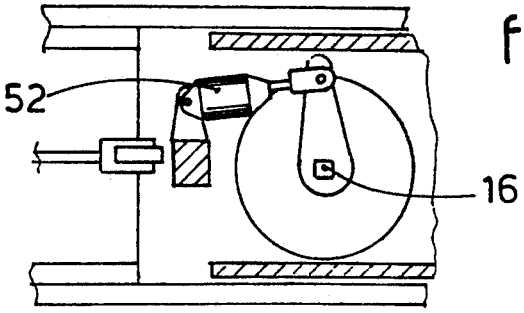

FIGS. 9 show the positioner fork means 20 and, in particular, the relative actuation means if the fork means 20 have to act also as transfer means.

In this example the actuation means of the fork means 20 consist of a first actuator 49 which makes possible a horizontal traversing movement of the fork means 20 on a slider 53, a second actuator 50 which causes rotation of the fork means 20 about a pivot 51 solidly fixed to the slider 53, and a third actuator 52 which rotates the fork means 20 about their central axis 16.

According to a variant the traversing movement towards the first roller conveyor 17 is caused by a first actuator 49 solidly fixed to the fork means 20 themselves; in this way the pivot 51 takes on a stationary position, as can be seen also in the diagrams of FIGS. 7.

Suitable clutch means or torsion regulation means, which are not shown here, are included so that the fork means 20, by rotating about their axis 16, will not deform the bars 14.

A feed of bars 14 directly from rolls 23 is provided in cooperation with, or instead of, the compartmented store 13. In this case an auxiliary feeder assembly 24 will consist of a straightening machine 25, a first shears 26 and a second roller conveyor 27.

In this example the second roller conveyor 27 cooperates with traversing conveyor means 28 equipped with projections 29, which convey the bars 14 onto a third roller conveyor 30 that butts the bars 14 against the abutment face 18.

The first 17 and third 30 roller conveyors contain substantially the same parts and perform substantially the same functions and therefore bear the same reference numbers.

When so required by the cycle as described above, the bundle of bars 14 on the third roller conveyor 30 is transferred into the positioner fork means 20.

According to a variant the second roller conveyor 27 cooperates directly with the first traversing roller conveyor 17.

The ability to receive bundles of bars 14 either from the compartmented store 13 or from the auxiliary feeder assembly 24 ensures good working and output of the plant 10 performing selection and bending of bars 14 and also a plentiful source of supply.

In this step of the process the butted bundle of bars 14 lies lodged in the positioner fork means 20; the leading ends of the bars 14 are aligned and positioned immediately upstream of a shearing and bending platform 12 and are prearranged to cooperate with a movable arm 31.

The movable arm 31 is borne on a carriage 32 and can run along a runway 33 arranged along the shearing and bending platform 12.

The movable arm 31 is equipped with movable engagement grippers 34 and has the task of engaging and drawing with itself the bundle of bars 14 until the bars 14 cooperate with blades of a second shears 39 positioned upstream of the shearing and bending platform 12.

The movable arm 31, when it passes in the vicinity of the second shears 39, has to be displaced upwards and to take the bundle of bars 14 with it so as not to contact the second shears 39.

Figure 3:
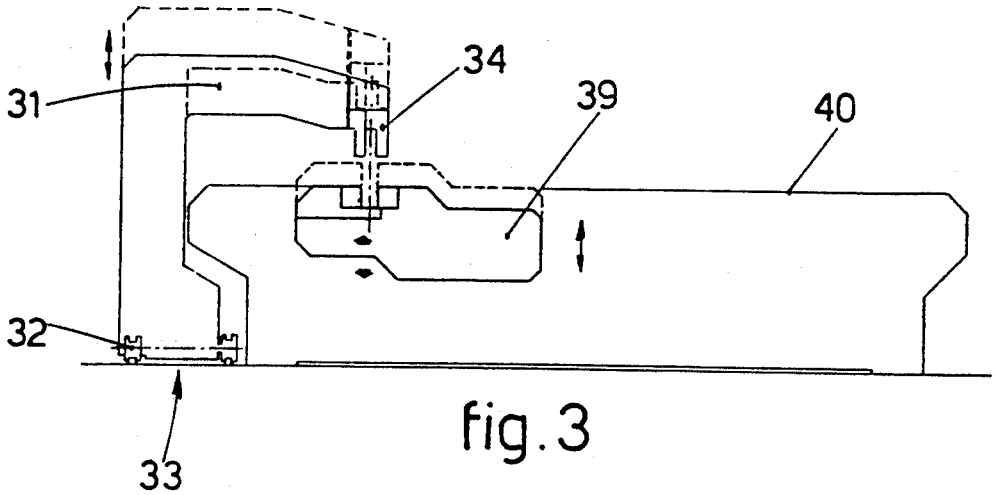
FIG. 3 shows a cross section of the possible system of cooperation between the movable arm and the shears along the line B—B of FIG. 1.
Figure 4:
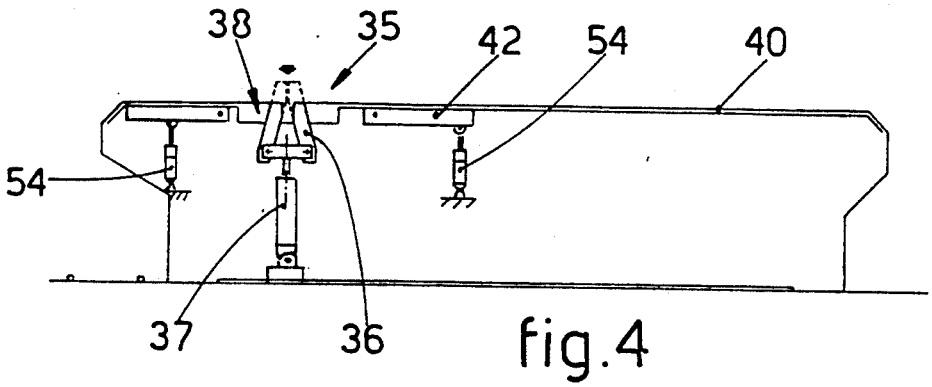
FIG. 4 shows a cross section of the zone of cooperation of the retaining means with the bending unit along the line C—C of FIG. 1.
Figure 5:
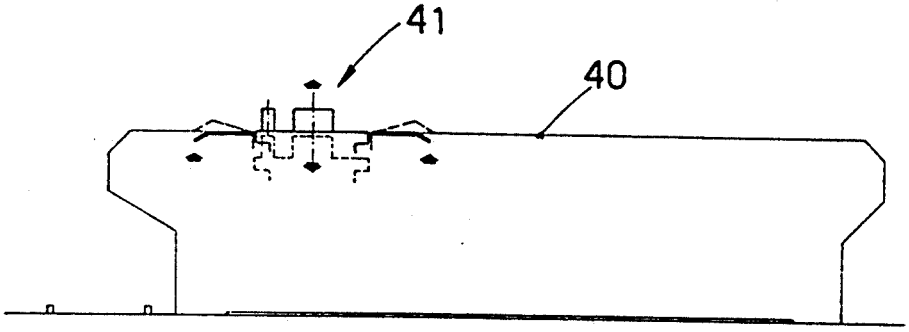
FIG. 5 shows a cross section of the bending unit along the line D—D of FIG. 1.

A variant provides for the second shears 39 to be able to move vertically and to be retracted beneath the level of a supporting bench 40 when the movable arm 31 passes by (see FIG. 3).

FIG. 12 shows the terminal portion of the movable arm 31 and makes clear, in particular, the kinematic mechanisms of the embodiment in question.

The upward vertical movement of the movable arm 31 to avoid contacting the second shears 39, if the second shears 39 cannot move and the movable arm 31 has to pass thereover, is actuated by a sixth actuator 55.

This sixth actuator 55 makes possible the displacement of a whole movable part 56 of the movable arm 31, which movable part 56 bears movable engagement grippers 34; this movable part 56 bearing the movable engagement grippers 34 is constrained by a structure 57 of the movable arm 31 but is free to rise vertically within suitable guides 58.

Actuation of the movable engagement grippers 34 to grasp or release the bundle of bars 14 is caused by operating a seventh actuator 65, which in this case cooperates directly with a transmission 59 consisting of two arms **60*a* and 60*b* able to move only lengthwise and connected to the movable engagement gripper portions 34*a* and 34*b*** respectively.

The transmission arms **60*a* and 60*b* are connected together by a lever 61 arranged in such a way that it can transmit an equal lengthwise displacement in opposite directions to the transmission arms 60*a* and 60*b***.

In this way, when the seventh actuator 65 is operated, there is an equal approach (or distancing) of the two movable engagement gripper portions **34*a* and 34*b* until they grip (or release) the bundle of bars 14**.

When the movable engagement gripper portions **34*a*–34*b* grip the bundle of bars 14, a suitable eighth actuator 64 causes the movement of a piston 66 which, owing to the inclusion of mating seatings 62 machined in the inner sides of the movable engagement gripper portions 34*a*–34*b*, compresses the bundle of bars 14 downwards against inwardly projecting ledges 63 so as to ensure a firm engagement of the movable engagement gripper 34 and therefore a necessary stability of the bundle of bars 14** being processed.

In this example cylinder/piston actuators have been included, but, in general, rack-and-pinion devices or any other known system suitable for the purpose could be comprised.

When the movable arm 31 has been positioned lengthwise and therefore has positioned the leading end of the bundle of bars 14 in relation to the shearing line of the second shears 39, the bars 14 are sheared if the cycle so requires.

Suitable control and governing means take into account the position of the lateral projection of the abutment face 18 in relation to the shearing line of the second shears 39 and govern the lengthwise movement of the movable arm 31.

A bending unit 41 is located on the shearing and bending platform 12 on the axis of the line of the passage 21 of the bundle of bars 14. This bending unit 41 is advantageously of the type disclosed in EP-A-379029 and comprises known means to invert bends.

Retaining means 35, which in this case are two clamping grippers 36, one upstream and the other downstream, cooperate advantageously with the bending unit and are positioned on the axis of the line of passage 21 of the bundle of bars 14, this line 21 being at a tangent to a stop element of the bending unit 41.

Figure 8A:
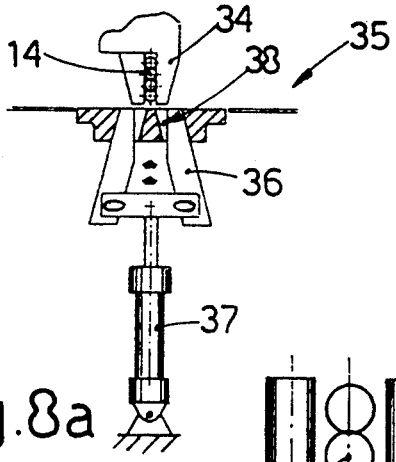
FIGS. 8*a* and 8*b* show the working of the retaining means cooperating with the bending unit.
Figure 8B:
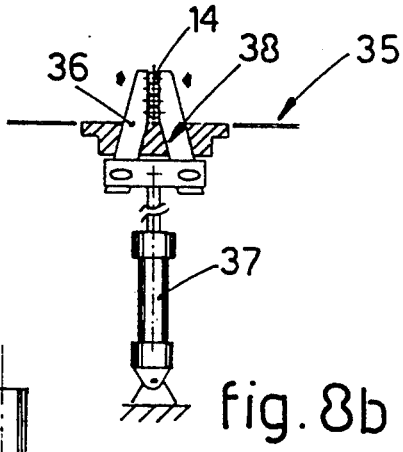

The clamping grippers 36 cooperate with suitable lateral guides 38 and are actuated by suitable fifth actuators 37 (see FIG. 8). When the cycle so requires, the clamping grippers 36 are retracted beneath the level of the supporting bench 40 (see FIG. 8*a*).

The clamping gripper 36 located upstream of the bending unit 41 has the task of clamping the bundle of bars 14 when a bend has to be imparted to the bundle of bars 14 downstream of the bending unit 41 itself.

Instead, the clamping gripper 36 located downstream of the bending unit 41 has the task of clamping the bundle of bars 14 for a bend to be applied upstream of the bending unit 41.

According to a variant a second movable arm 31 may be included to cooperate with the line of passage 21 of the bars 14 and with the first movable arm 31; the second movable arm 31 will be positioned downstream of the bending unit 41 so as to position and move the leading end of the bars 14 in this zone.

Next, the movable arm 31 positions the bundle of bars 14, whether sheared to size or not by the second shears 39 according to the length to be processed, within the known bending unit 41, while the relative clamping grippers 36 clamp the bundle of bars 14.

FIGS. 10 and 11 show two applications of the invention. The bundle of bars 14 is positioned by the movable engagement gripper 34 of the movable arm 31 at the right length on the shearing and bending platform 12 (see FIGS. 10*a* and 11*a*).

When the bundle of bars 14 has been clamped by the clamping grippers 36, the movable engagement gripper 34 of the movable arm 31 releases its grip and the movable arm 31 is re-positioned as required by the cycle.

The first bend, for instance a clockwise bend (see FIGS. 10*b* and 11*b*), is now applied at the leading end of the bars 14.

Figure 10A:
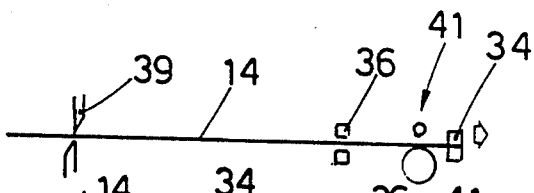
FIGS. 10*a*–10*i* and 10*l* show a first bending cycle.
Figure 10B:
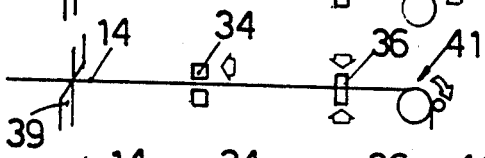
Figure 10C:
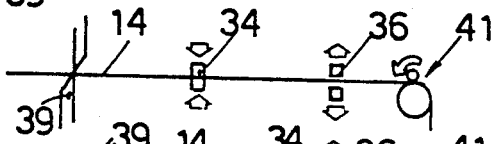
Figure 10D:
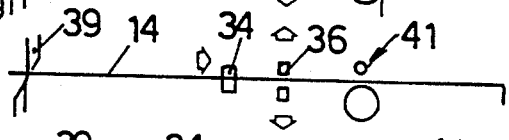
Figure 11A:
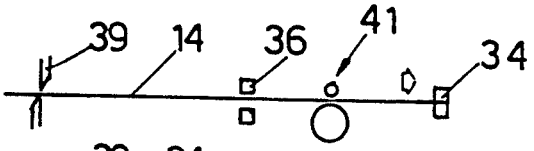
FIGS. 11*a*–11*i* show a second bending cycle.
Figure 11B:
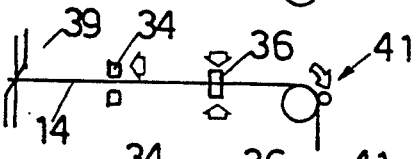
Figure 11C:
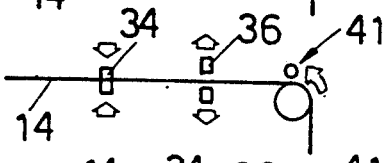
Figure 11D:
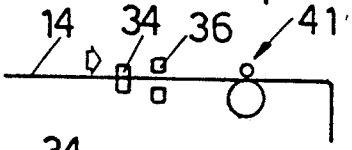

The movable engagement gripper 34 of the movable arm 31 re-engages the bundle of bars 14, while the clamping grippers 36 are opened within the supporting bench 40; the bending unit 41 is re-positioned (see FIGS. 10*c* and 11*c*).

The movable arm 31 is moved according to the second bent segment to be made and positions the bundle of bars 14 in a manner analogous to that described above (see FIGS. 10*d* and 11*d*).

Figure 10E:
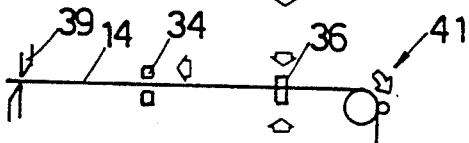
Figure 11E:
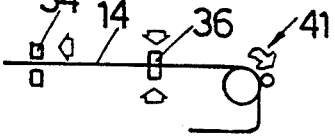

The second bend is now made, for instance a clockwise bend at the leading end of the bars 14 (see FIGS. 10*e* and 11*e*).

Figure 11F:
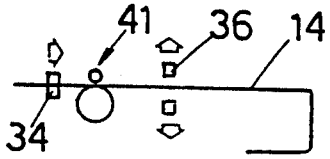
Figure 11G:
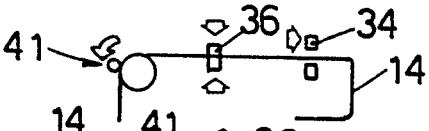
Figure 11H:
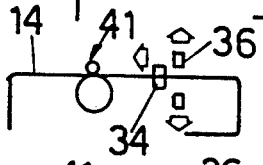

In the example shown in FIGS. 11 the third bend is made in a manner analogous to the bends previously described, the clamping grippers 36 taking action downstream of the bending unit 41 (see FIGS. 11*f* and 11*g*).

Figure 11I:
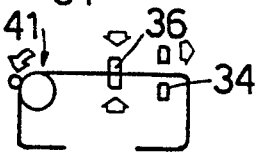

To make the fourth bend, the movable arm 31 positions the bundle of bars 14 in a suitable position (FIG. 11*h*); then the movable engagement gripper 34 of the movable arm 31 releases its grip, while the clamping grippers 36 downstream of the bending unit 41 grip the bundle of bars 14; the fourth bend, an anticlockwise bend at the trailing end of the bars 14, is now made (see FIG. 11*i*).

Figure 10F:
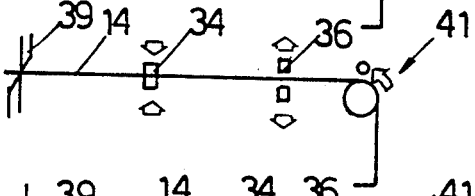
Figure 10G:
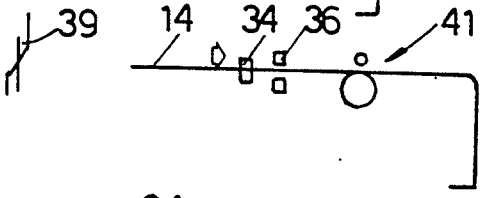

To make the third clockwise bend at the leading end of the bars 14 in the situation of FIGS. 10, the same steps are taken as in the case of the first and second bends (see FIGS. 10*f* and 10*g*).

Figure 10H:
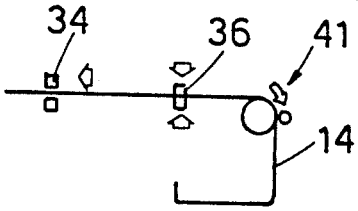

A different method is used to make the fourth bend. Suitable auxiliary arms 42 arranged around the periphery of the bending unit 41 ar included which are pivoted on the supporting bench 40 along axes 43 substantially parallel to the supporting bench 40 and are actuated by suitable fourth actuators 54. These auxiliary arms 42 enable the bending unit 41 to make bends also which lead to superimposing of segments of the same bundle of bars on top of each other (FIG. 10*h*).

In fact, when the auxiliary arms 42 are raised suitably, it is possible to raise the segment of the bars 14 which otherwise could prevent formation of the bend to be made.

Figure 10I:
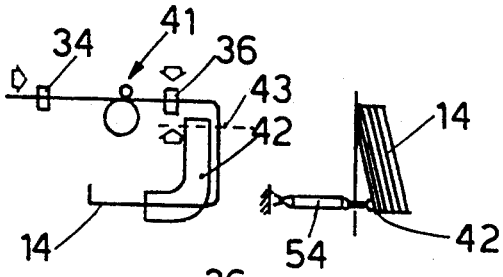

FIG. 10*i* shows how the first bend would obstruct formation of the fourth bend, whereas by raising the appropriate auxiliary arm 42 it is possible to obtain an extra lifting of the first segment of the bundle of bars 14 so that this segment does not come into contact with the remainder of the bundle of bars 14 during the bending step (see the section on the auxiliary arm of FIG. 10*i*, as shown on the right of the figure).

Figure 10L:
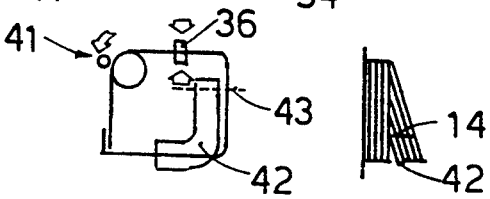

FIG. 10*l* shows the bundle of bars 14 after a fourth anticlockwise bend has been made at the trailing end of the bars 14; the lateral view of FIG. 10*l* (positioned at the right of the figure) shows the raising of the trailing end of the bars 14 by the auxiliary arm 42.

Thus, owing to the reciprocal action of the second shears 39, movable arm 31, front and rear clamping grippers 36 and bending unit 41 it is possible to obtain bundles of bars 14 having the required length and bends.

FIGS. 14 show a third application of the invention. The bundle of bars 14 is positioned at the right length on the shearing and bending platform 12 by the movable engagement gripper 34 of the movable arm 31 (see FIG. 14*a*).

When the bundle of bars 14 is clamped by the clamping grippers 36 positioned upstream of the bending unit 41, the movable engagement grippers 34 release their grasp and the movable arm 31 is re-positioned according to the requirements of the cycle.

Figure 14A:
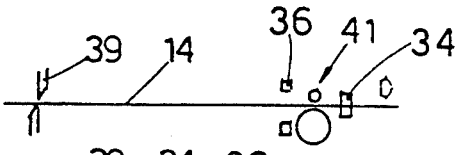
FIGS. 14*a*–14*i*, 14*l*, 14*m* and 14*n* show a third bending cycle.
Figure 14B:
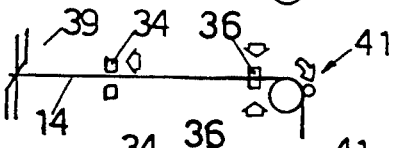

The first bend is now made, for instance a clockwise bend in the leading end (see FIG. 14*b*).

Figure 14C:
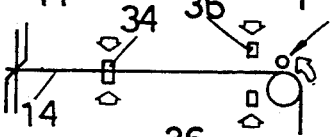

The movable engagement grippers 34 of the movable arm 31 re-engage the bundle of bars 14 while the clamping grippers 36 open within the supporting bench 40; the bending unit 41 is re-positioned (see FIG. 14*c*).

Figure 14D:
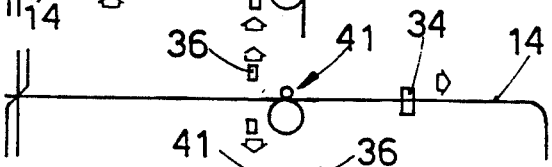

The movable arm 31, while the bundle of bars 14 is clamped in the movable engagement gripper 34, is displaced so as to feed the bundle of bars 14 forwards by the required length; the second shears 39 is then actuated and shears the bars to size (see FIG. 14*d*).

Figure 14E:
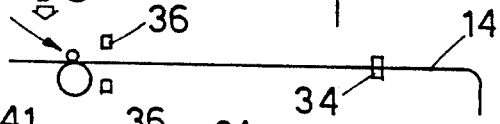
Figure 14F:
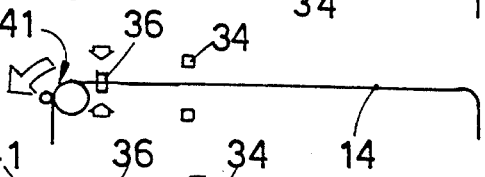
Figure 14G:
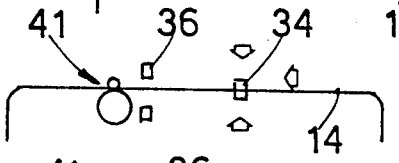
Figure 14H:
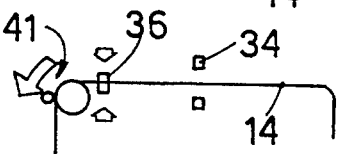
Figure 14I:
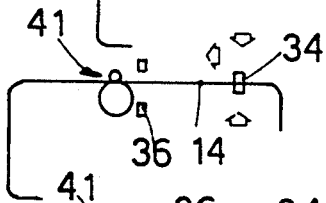
Figure 14L:
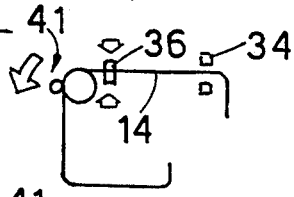

The bundle of bars 14 now sheared to size is then positioned for application of the terminal bend (see FIG. 14*e*). The terminal bend, for example anticlockwise at the trailing end, is then made (see FIG. 14*f*).

The bundle of bars 14 is then retracted upstream by the required length for each bend so that the third (see FIGS. 14*g*–14*h*) and fourth (see FIGS. 14*i*–14*l*) bends can be made, and these bends are applied in the same manner as the terminal bend in the trailing end, the clamping grippers 36 located downstream of the bending unit 41 coming into action.

Figure 14M:
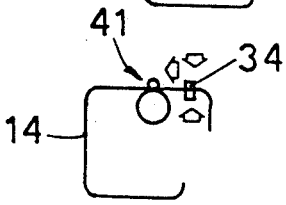

For application of the fifth bend the movable arm 31 positions the bundle of bars 14 by retracting the bundle upstream by the required length (FIG. 14*m*).

Figure 14N:
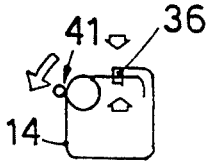
Figure 15:
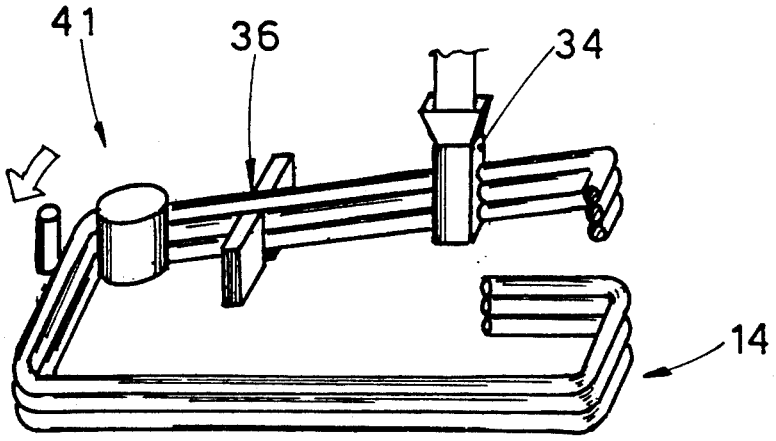
FIG. 15 shows a three-dimensional view of the application of the last bend of the bending cycle of FIGS. 14.

The movable engagement gripper 34 of the movable arm 31, which keeps the first segment of the bundle of bars 14 gripped, now raises the bundle 14 for application of the fifth bend (see FIGS. 14*n*–15).

In this way the bundle of bars 14 can be bent, and bent bars are obtained which have their terminal segments superimposed on each other.

Figure 16:
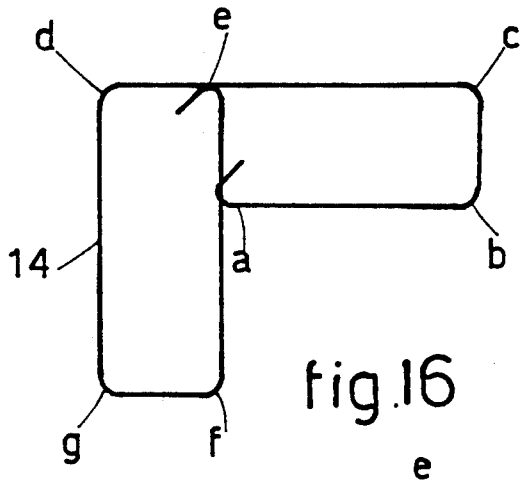
FIGS. 16, 17 and 18 show some shapes of stirrups which can be made with the method according to the invention.
Figure 17:
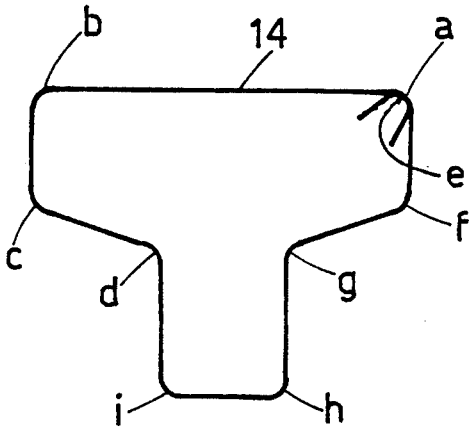
Figure 18:
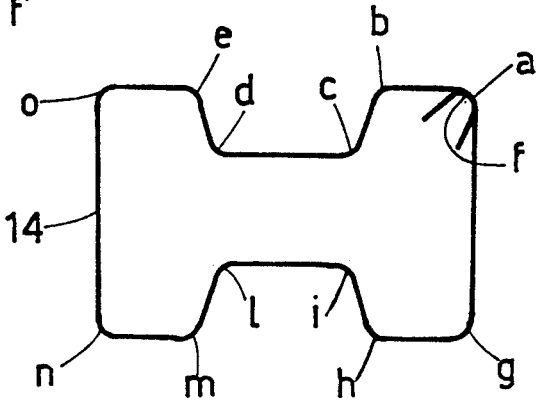

FIGS. 16 to 18 show some stirrups which are produced with the method, which provides for the forward feeding, shearing and upstream retraction of the bundle of bars 14.

According to this method a first series of bends is made by causing the bundle of bars 14 to advance for each bend; the bundle of bars 14 is then fed forwards by the whole required length, and the shears is then actuated and shears the bars 14 to size.

The bundle of bars 14 is then retracted upstream by the required length for each bend and the remaining bends are applied.

The number of bends made by feeding the bundle of bars 14 forwards before the bars 14 are sheared to size will vary according to the shape of the stirrup to be produced.

In the example of FIGS. 16 and 17 the first four bends marked with "a", "b", "c" and "d" are applied by feeding the bundle of bars forwards for each bend and making the desired bend; the partly bent bundle of bars 14 is then fed forwards by the required length and sheared; the remaining bends (e, f and g) respectively in the case of FIG. 16 and (e, f, g, h and i) in the case of FIG. 17 are made by retracting the bundle of bars 14 upstream for each bend by the required length.

In the stirrup of FIG. 18 the first five bends (a, b, c, d and e) are made by feeding the bundle of bars 14 forward; the bundle is then fed forwards by the required length and sheared; the other eight bends (f, g, h, i, l, m, n and o) are made by retracting the bundle of bars upstream.

It is clear that a variation in the shape of the stirrup will lead to a variation in the number of bends to be made during the forward feeding step and the upstream retraction step.

The bending unit 41 cooperates with a supporting bench 40 of a great size so as to enable bends even of very great forms to be made.

Figure 6:
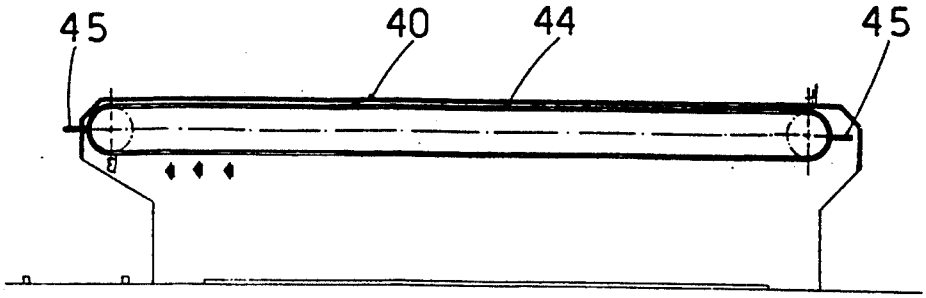
FIG. 6 shows a cross section of the conveyor means along the line E—E of FIG. 1.

Downstream of the bending unit 41 the supporting bench 40 comprises conveyor means 44, which in this case consist of a discharge conveyor belt positioned lengthwise and equipped with projections 45 (see FIG. 6).

The discharge conveyor belt 44 is operated only when it is necessary to take from the supporting bench 40 a bundle or bundles of bars 14 already bent and ready for further operations.

We claim:

1. A plant to select and bend bars for building work, which is suitable to select and bend simultaneously in a substantially identical manner a plurality of bars, starting with substantially identical bars, comprising:

at least one store for storing bars;

a first traversing roller conveyor for conveying bars from said at least one store and including an abutment face for butting leading ends of a plurality of bars;

fork means for receiving from said first traversing roller conveyor a bundle of bars whose leading ends have been butted by said abutment face and for positioning and vertically aligning said bundle of bars in a stacked arrangement with the longitudinal axis of the bundle of bars extending horizontally;

a bending unit for bending said bundle of bars;

a supporting bench supporting said bending unit;

shears positioned upstream of said bending unit for shearing bars of said bundle to size, wherein said fork means is positioned between said first traversing roller conveyor and said shears; and a movable engagement and positioning arm for engaging a bundle of bars from said fork means and for moving and positioning said bundle in a direction along said longitudinal axis of said bundle, said movable engagement and positioning arm including in its lower portion a movable engagement gripper for gripping said bundle;

wherein said movable engagement and positioning arm and said shears are vertically movable relative to one another so that said movable engagement and positioning arm is capable of passing said shears as said movable engagement and positioning arm moves in said direction.

2. Plant as claimed in claim 1, wherein said at least one store comprises a plurality of compartments within which are positioned bars according to their cross section or material of which they are made.

3. Plant as claimed in claim 1, further comprising means for vertically moving said movable engagement and positioning arm to enable said movable engagement and positioning arm to pass over said shears.

4. Plant as claimed in claim 1, wherein said shears is movable vertically such that it can be retracted below a surface of said supporting bench.

5. Plant as claimed in claim 1, further comprising an auxiliary feeder assembly containing feed materials in rolls included in cooperation with the fork means.

6. Plant as claimed in claim 1, wherein said first traversing roller conveyor comprises means to transfer a selected bundle of bars into said fork means.

7. Plant as claimed in claim 1, wherein said first traversing roller conveyor has a lateral development sloped towards said fork means, retractible stops being included in a position intermediate said first traversing roller conveyor and said fork means.

8. Plant as claimed in claim 1, wherein said fork means can perform a substantially rotary movement about its vertical central axis.

9. Plant as claimed in claim 1, wherein said fork means can perform a lateral rotary movement associated wit a linear movement cooperating with the first traversing roller conveyor.

10. Plant as claimed in claim 1, wherein said fork means has a vertical axis and comprises idler rollers having parallel axes positioned substantially symmetrically and parallel to the vertical axis of said fork means.

11. Plant as claimed in claim 1, wherein said bending unit comprises a plurality of retaining means for clamping the bundle of bars while said bending unit bends the bundle, the retaining means being vertically movable between a clamping position and a retracted position, and being located upstream and downstream of the bending unit.

12. Plant as claimed in claim 1, wherein said bending unit comprises auxiliary arms to raise a terminal bent portion of the bundle of bars.

13. Plant as claimed in claim 1, wherein said supporting bench comprises lateral conveyor means for conveying a bent bundle of bars from said bending unit.

14. Plant as claimed in claim 1, wherein said retaining means comprise lateral guides having a conical development and cooperating with clamping grippers.

15. Plant as claimed in claim 1, wherein said movable engagement gripper includes facing grippers, able to move in a counterpart manner in relation to each other and having parallel engagement walls, and cooperating at their upper end with a piston for applying vertical pressure.

16. Plant as claimed in claim 15, wherein each of said gripper portions comprises a ledge at its lower end which extends towards the other gripper portion.

* * * * *